US009028008B1

(12) United States Patent
Bookhamer

(10) Patent No.: US 9,028,008 B1
(45) Date of Patent: May 12, 2015

(54) CUTTING TOOL ASSEMBLY INCLUDING RETAINER SLEEVE WITH COMPRESSION BAND

(71) Applicant: Kennametal Inc., Latrobe, PA (US)

(72) Inventor: Paul A. Bookhamer, Altoona, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 14/157,221

(22) Filed: Jan. 16, 2014

(51) Int. Cl.
*E21C 25/10* (2006.01)
*E21C 35/197* (2006.01)
*E21C 35/19* (2006.01)

(52) U.S. Cl.
CPC ..... *E21C 35/197* (2013.01); *E21C 2035/191* (2013.01)

(58) Field of Classification Search
CPC ..... E21C 35/197
See application file for complete search history.

(56) References Cited

U.S. PATENT DOCUMENTS 4,603,911 A * 8/1986 Hindmarsh et al. ..... 299/104
4,818,027 A * 4/1989 Simon ..... 299/107
5,303,984 A 4/1994 Ojanen
5,503,463 A 4/1996 Ojanen
5,873,423 A * 2/1999 Briese ..... 175/427
6,378,952 B1 4/2002 Moosmann et al.
8,573,707 B2 11/2013 Swope
2003/0137185 A1 * 7/2003 Sollami ..... 299/106
2011/0163591 A1 * 7/2011 Sleep et al. ..... 299/104
2012/0049608 A1 3/2012 Ritchey et al.

* cited by examiner

*Primary Examiner* — John Kreck
(74) *Attorney, Agent, or Firm* — Larry R. Meenan

(57) ABSTRACT

A cutting tool assembly for mounting in a bore of a holder includes a cutting tool having a head, a shank and a collar therebetween having an axially rearward surface that defines an annular channel adjacent an axially forward end of the shank. The assembly also includes a retainer sleeve substantially surrounding the shank and defining a slot that extends from an axial forward end to an axial rearward end of the retainer sleeve. The retainer sleeve is compressible between an expanded state and a compressed state. The assembly further includes a compression band removably attached to the retainer sleeve. The compression band in a first position is attached to the retainer sleeve and compresses the retainer sleeve to the compressed state and in a second position is not attached to the retainer sleeve and the retainer sleeve is in the expanded state.

19 Claims, 7 Drawing Sheets

CUTTING TOOL ASSEMBLY INCLUDING RETAINER SLEEVE WITH COMPRESSION BAND

BACKGROUND OF THE INVENTION

The present invention relates to cutting tools and cutting tool assemblies used for mining and construction and, more particularly, relates to a retainer with compression band for such cutting tools and cutting tool assemblies.

Rotatable cutting tools are used in conjunction with a machine used to break up (or cut) a substrate such as coal, rock, asphalt pavement, asphaltic concrete, concrete or the like. In its very basic aspects, such a machine includes a driven member (e.g., a chain, a wheel or a drum), a holder either directly or indirectly mounted in a block to the driven member, and a rotatable cutting tool rotatably held in the holder. It is the cutting tool that impinges the substrate so as to break it into pieces upon impact.

As known to those skilled in the art, the useful life of the holder is much longer than the useful life of the cutting tool. A holder is often used in association with a block to hold a cutting bit. Each holder is intended to accommodate many changes of cutting tools before the holder must be changed. In order to reduce the wear on the forward face of the holder and wear between the holder and the cutting bit, a wear sleeve (also which may be referred to as, for example, a retention sleeve, retainer sleeve, retainer or the like) may be used in conjunction with the cutting tool and the holder. The wear sleeve generally is positioned between the cutting tool and holder. The retention wear sleeve protects the holder from wear and is removably mounted in the holder.

There has been identified a need for improved cutting tool assemblies and/or related components, e.g. wear sleeves, that overcome limitations, shortcomings and disadvantages of known cutting tool assemblies and/or related components.

SUMMARY OF THE INVENTION

In accordance with an aspect of the invention, a cutting tool assembly for mounting in a bore of a holder includes a cutting tool having a head portion, a shank portion and a collar portion therebetween, the collar portion having an axially rearward surface that defines an annular channel adjacent an axially forward end of the shank portion. The assembly also includes a retainer sleeve substantially surrounding the shank portion, the retainer sleeve defining a slot that extends from an axial forward end to an axial rearward end of the retainer sleeve, wherein the retainer sleeve is resilient and compressible between an expanded state and a compressed state. The assembly further includes a compression band removably attached to the retainer sleeve, wherein the compression band in a first position is attached to the retainer sleeve and compresses the retainer sleeve to the compressed state and in a second position is not attached to the retainer sleeve and the retainer sleeve is in the expanded state.

In accordance with another aspect of the invention, a tool assembly for mounting in a bore of a holder includes: a holder having a front face that defines a longitudinal bore extending at least partially through the holder; a cutting tool having a head portion, a shank portion and a collar portion therebetween, the collar portion having an axially rearward surface that defines an annular channel adjacent an axially forward end of the shank portion; a retainer sleeve substantially surrounding the shank portion and configured for being removably received in the longitudinal bore of the holder, the retainer sleeve defining a slot that extends from an axial forward end to an axial rearward end of the retainer sleeve, wherein the retainer sleeve is resilient and compressible between an expanded state and a compressed state; and a compression band removably attached to the retainer sleeve, wherein the compression band in a first position is attached to the retainer sleeve and compresses the retainer sleeve to the compressed state and in a second position is not attached to the retainer sleeve and the retainer sleeve is in the expanded state.

These and other aspects of the present invention will be more fully understood following a review of this specification and drawings.

DETAILED DESCRIPTION

Figure 1:
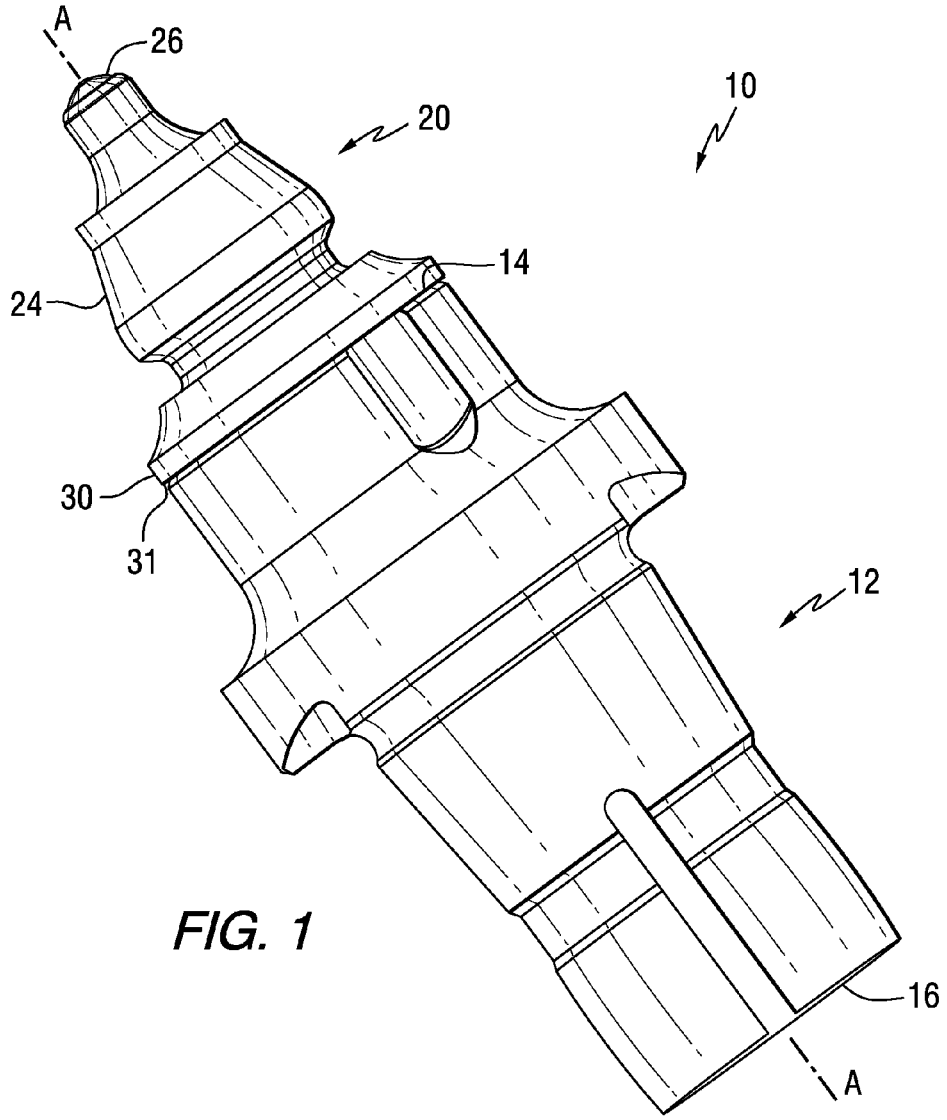
FIG. 1 is an isometric view of a tool assembly, in accordance with an aspect of the invention.
Figure 1A:
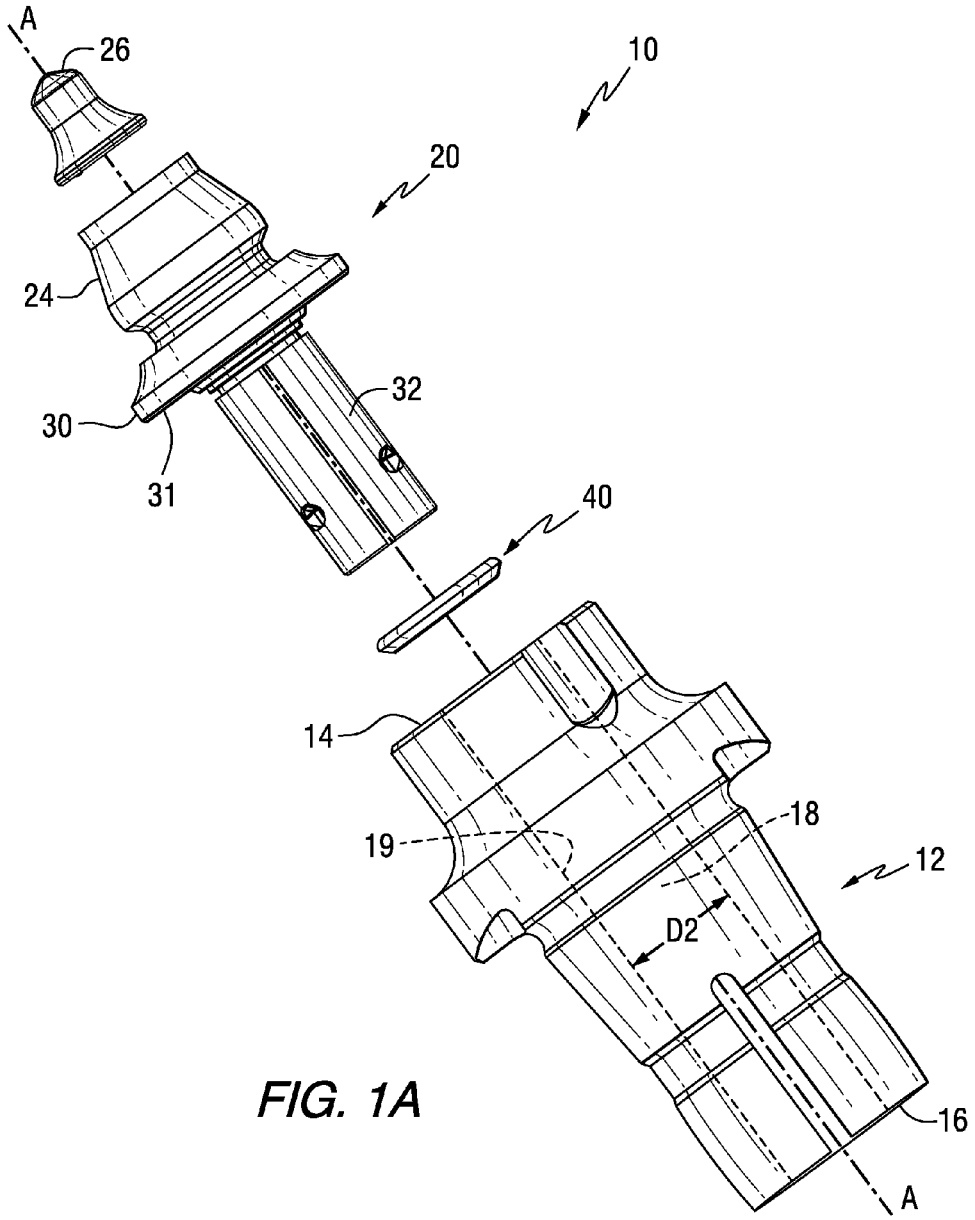
FIG. 1A is an exploded isometric view of the tool assembly illustrated in FIG. 1, in accordance with an aspect of the invention.

Referring now to FIGS. 1-1A, a tool assembly 10 is shown. The tool assembly 10 includes a holder 12, which may also generally be referred to as a tool holder, holder portion or the like. The holder 12 may be mounted to, received in or integrally formed with a block (not shown), as is generally known. The holder 12 includes a front face 14 and a rear face 16. The holder 12 and the front face 14 thereof define a longitudinal bore 18 extending axially at least partially through the holder 12, e.g., extending at least partially between the front face 14 and the rear face 16. The holder 12 is configured to removably receive a cutting tool assembly 20, which will now be explained in more detail.

Figure 2:
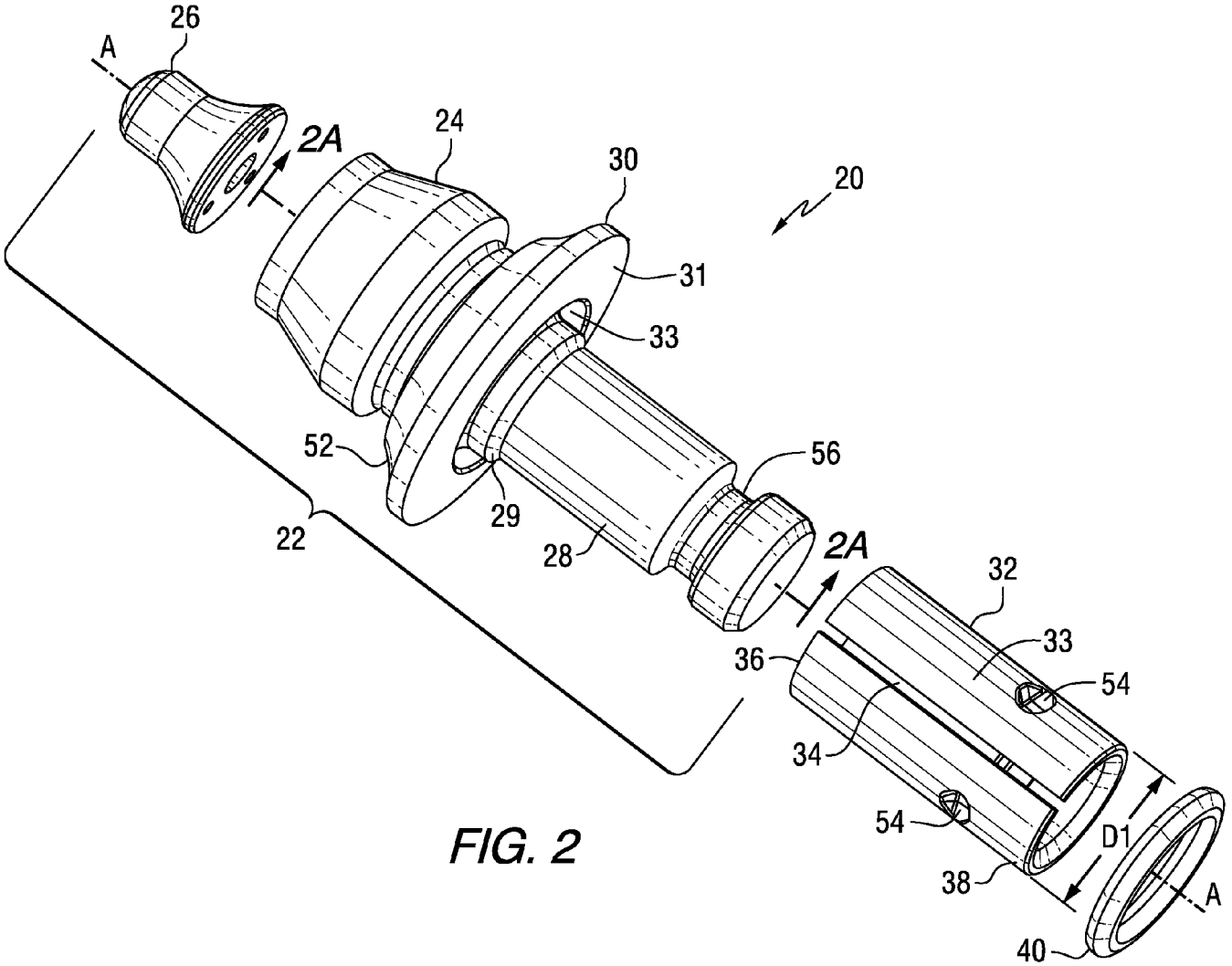
FIG. 2 is an exploded isometric view of a cutting tool assembly, in accordance with an aspect of the invention.
Figure 3:
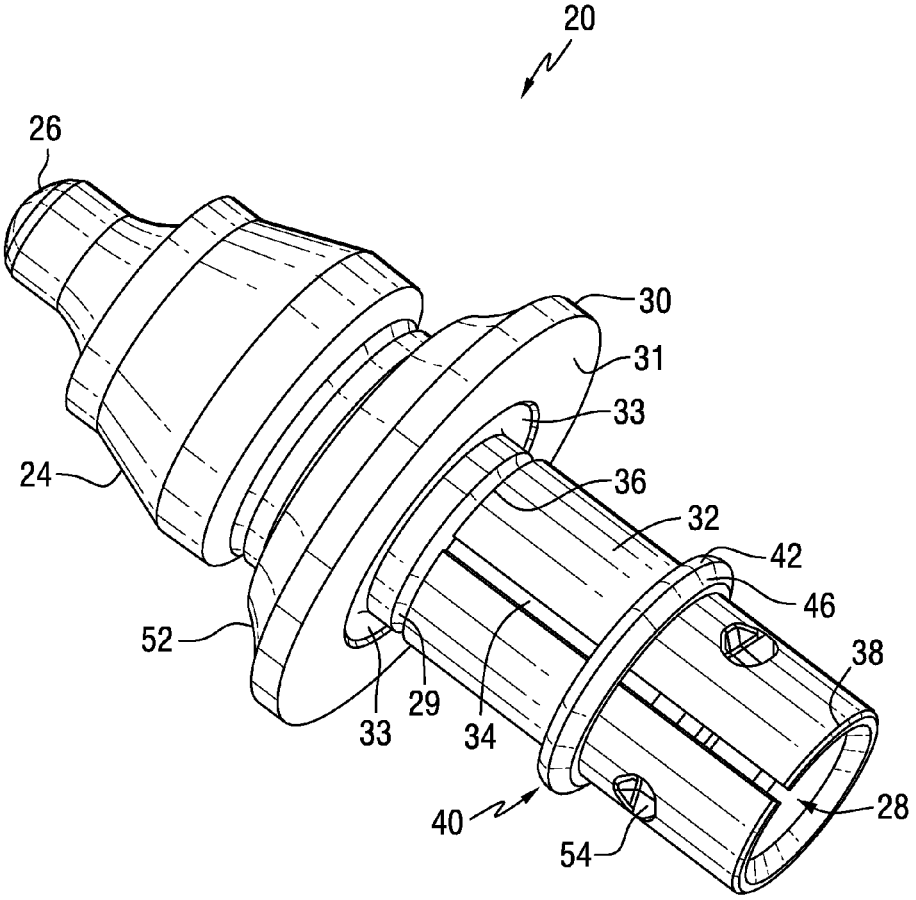
FIG. 3 is an isometric view of the cutting tool assembly, in accordance with an aspect of the invention.
Figure 4:
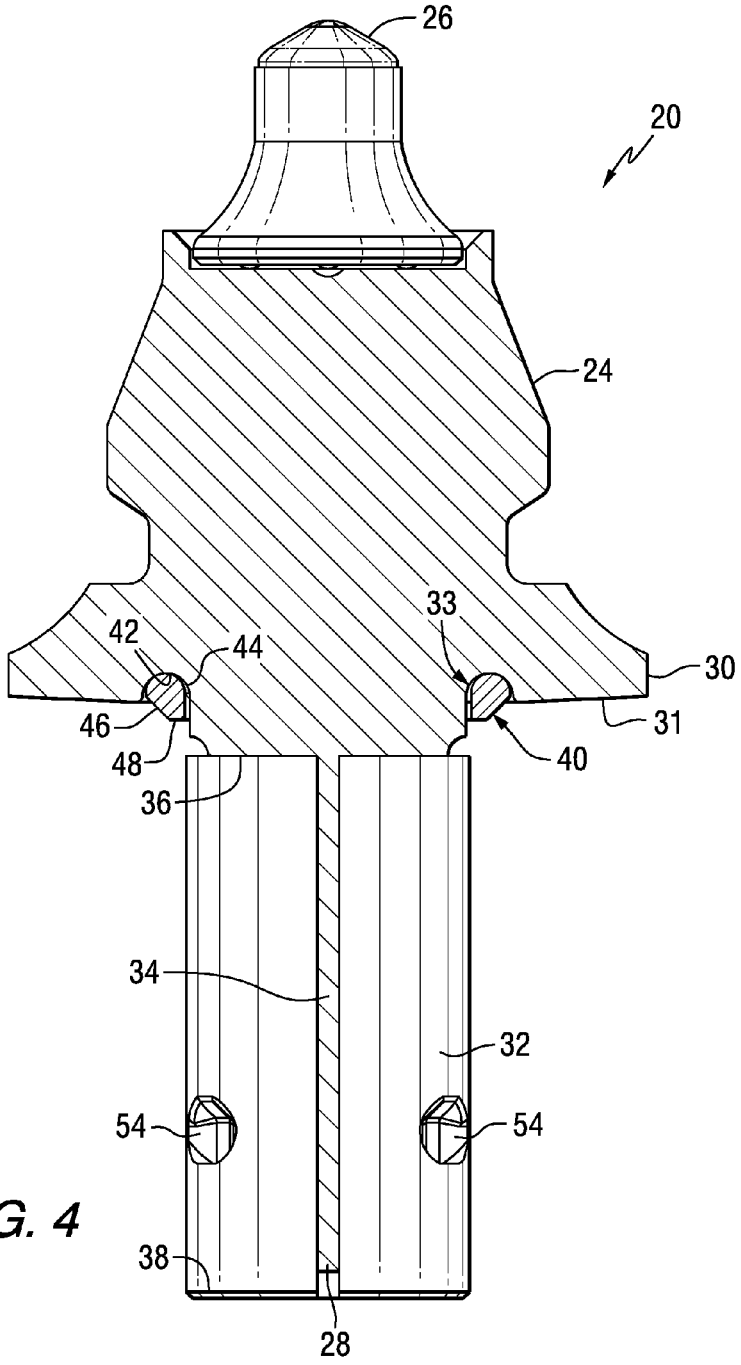
FIG. 4 is a partial sectional side view of the cutting tool assembly, in accordance with an aspect of the invention.

Referring to FIGS. 2-4, the cutting tool assembly 20 includes a cutting tool 22 such as, for example, a conical cutting tool. The cutting tool 22 includes a head portion 24 with a hard cutting tip 26, a shank portion 28 and a collar portion 30 therebetween, all disposed about a central longitudinal axis A-A of the cutting tool 22.

In one aspect of the invention, the collar portion 30 has an axially rearward surface 31 that defines an annular channel 33 adjacent an axially forward end 29 of the shank portion 28. In another aspect, the annular channel is continuous about an inner circumference of the collar portion 30 rearward surface 31 and is recessed below the rearward surface 31, i.e., defines an opening that extends axially toward the head portion 24.

The cutting tool assembly 20 also includes a retainer sleeve 32 (which also may be referred to as a retention sleeve, wear sleeve or the like) that defines a slot 34 that extends from an axial forward end 36 to an axial rearward end 38 of the retainer sleeve 32. Generally, the retainer sleeve 32 is configured to be placed on or about the shank portion 28 for insertion into the bore 18 of the holder 12 along with the shank portion 28, as will be described in detail herein. The retainer sleeve 32 is removably received in the bore 18, in one aspect.

In one aspect, the retainer sleeve 32 is configured to substantially surround the shank portion 28. In another aspect, the retainer sleeve 32 is formed of, for example, spring steel, and in conjunction with the slot 34, this provides for the retainer sleeve 32 to be resilient and compressible between an expanded state (see FIG. 2) and a compressed state (see FIG. 3).

When in the expanded state, the retainer sleeve 32 can be easily be fitted or positioned on or about the shank portion 28 for preparation of inserting the cutting tool 22 and, more specifically, the shank portion 28 thereof into the bore 18 of the holder 12. However, in one aspect the retainer sleeve 32 has an outer diameter D1 when in the expanded state that is greater than a diameter D2 of the bore 18. Thus, it will be appreciated that in order to insert the retainer sleeve 32/shank portion 28 into the bore 18 the retainer sleeve 32 needs to be sufficiently compressed.

In order to compress or squeeze the retainer sleeve 32, the cutting tool assembly further includes a compression band 40. In one aspect, the compression band 40 is generally circular. In another aspect, the compression band 40 is removably attachable to the retainer sleeve 32. In another aspect, the compression band 40 has an inner diameter D3 (see FIG. 5) that is less than the outside diameter D1 of the retainer sleeve 32 in the expanded state. Therefore, to initially attach or position the compression band 40 on the retainer sleeve 32, the retainer sleeve 32 needs to be compressed, which can be done, for example, mechanically or by hand depending upon the size, material, resiliency, etc. of the retainer sleeve 32.

The compression band 40 in a first position (see, for example, FIG. 3) is attached to the retainer sleeve 32 and compresses the retainer sleeve 32 to the compressed state. In one aspect, in the first position the compression band 40 is circumferentially disposed about an outer surface 33 of the retainer sleeve. In another aspect, the first position of the compression band 40 can be at any location along the retainer sleeve 32 from the axial forward end 36 to the axial rearward end 38 thereof.

To assemble the tool assembly 10, the compression band 40 is placed in a first position on the retainer sleeve 32 which in turn is positioned about the shank portion 28, as described herein. In accordance with an aspect of the invention, the compression band 40 is configured to be slidable from the axial rearward end 38 of the retainer sleeve 32 to the annular channel 33. Thus, as the retainer sleeve 32/shank portion 28 are inserted into the bore 18 of the holder 12 the compression band 40 will at some point contact the front face 14 of the holder 12 and begin to slide toward the axial forward end 36 as the retainer sleeve 32/shank portion 28 is inserted further into the bore 18. Eventually, the compression band 40 will reach the axial forward end 36 at which point continued insertion of the retainer sleeve 32/shank portion 28 into the bore 18 and continued contact between the compression band 40 and the front face 14 will cause the compression band 40 to become unattached or disengaged from the retainer sleeve 32 and be located in a second position. In this second position (see FIG. 4), the compression band 40 is received at least partially in the annular channel 33. In one aspect, the compression band 40 in the second position is spaced apart from the retainer sleeve 32.

In one aspect, the disengagement of the compression band 40 from the retainer sleeve 32 allows for the retainer sleeve 32 to expand a determined amount so as to engage an inner wall 19 of the bore 18 to provide a friction fit therebetween which holds the retainer sleeve 32 in place during operation and allow the shank portion 28 to rotate freely within the retainer sleeve 32.

In order to enhance, promote and/or facilitate the slidability of the compression band 40 on the retainer sleeve 32, the compression band 40 may include a friction reducing coating (as illustrated at 50 on FIG. 5) applied to all or parts thereof such as on the inner surface 51. The friction reducing coating can include, for example, zinc phosphate/oil. Alternatively, the compression band 40 can be formed of a material such as, for example, carbide, ceramic, coated ferrous or non-ferrous metals, thermoplastics, and/or hard rubber elastomers that enhances, promotes and/or facilitates the slidability of the compression band 40 on the retainer sleeve 32.

Figure 2A:
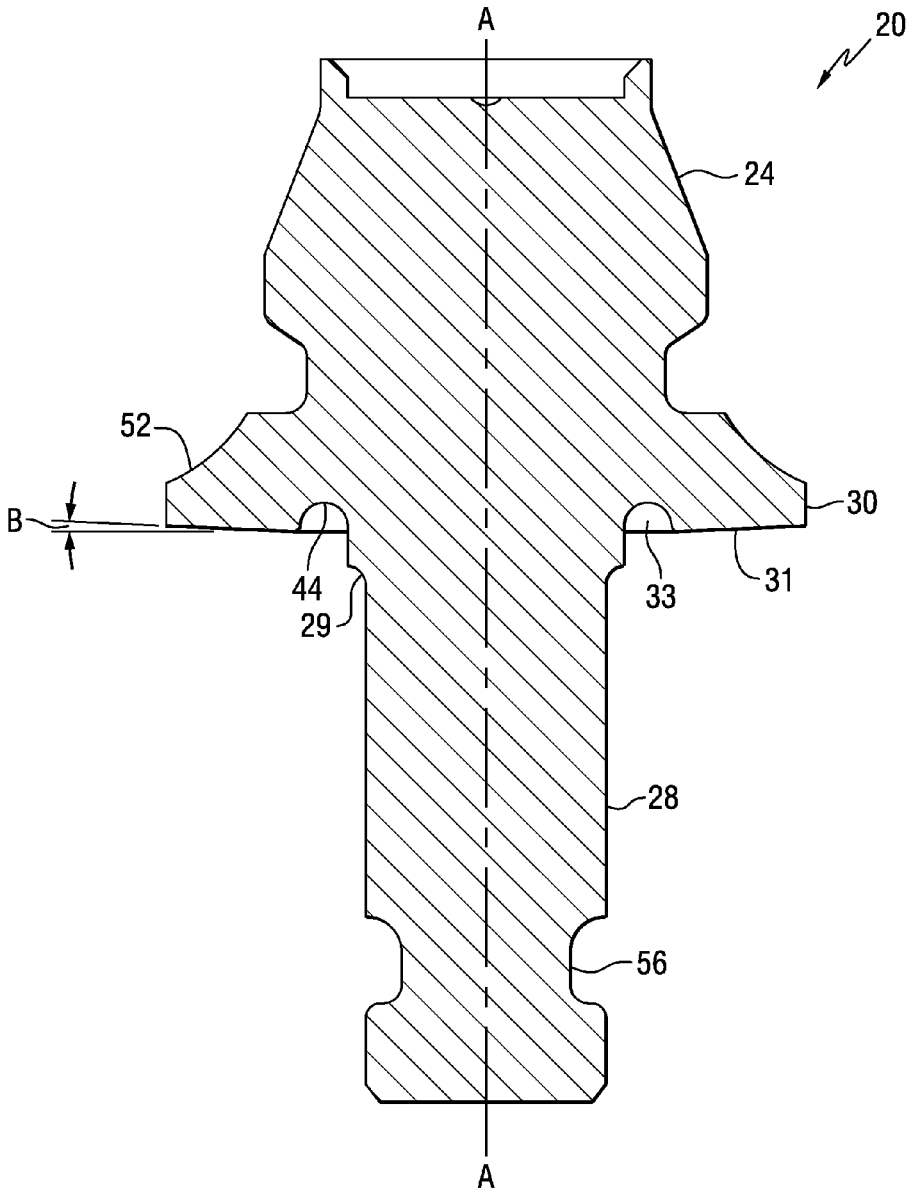
FIG. 2A is a sectional view taken along line 2A-2A of FIG. 2, in accordance with an aspect of the invention.
Figure 5:
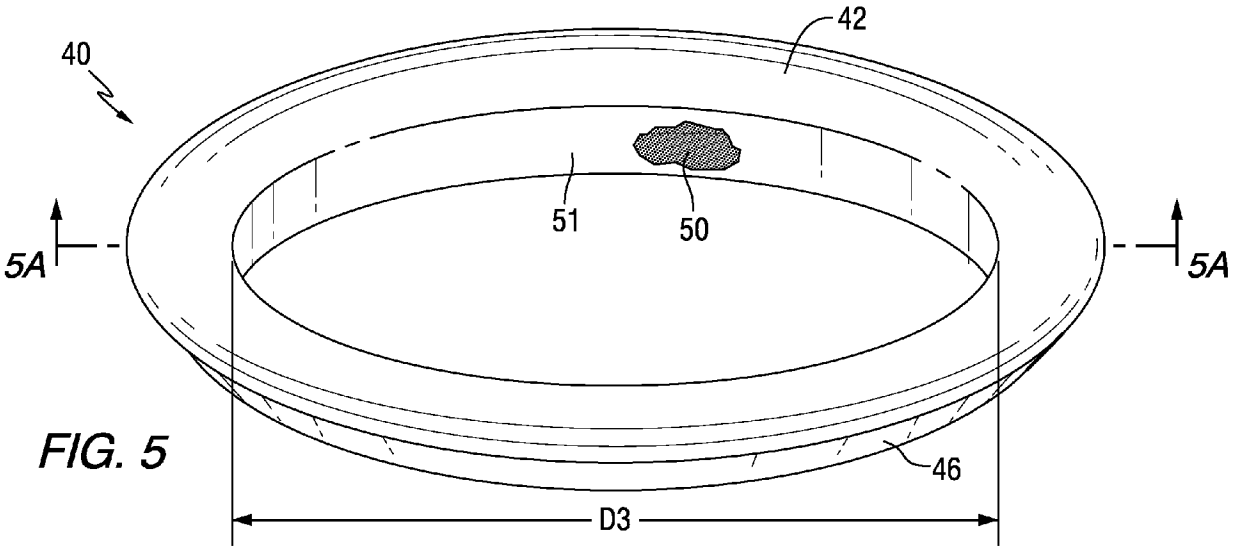
FIG. 5 is an isometric view of a compression band, in accordance with an aspect of the invention.
Figure 5A:
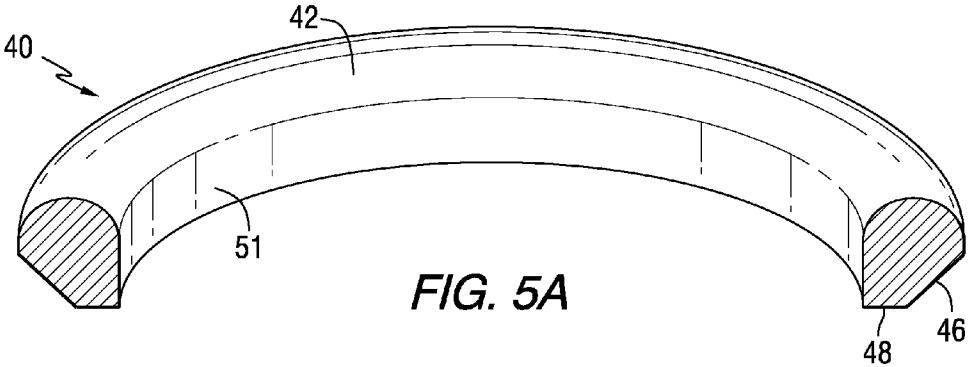
FIG. 5A is a sectional view taken along line 5A-5A of FIG. 5, in accordance with an aspect of the invention.

Referring to FIGS. 5-5A, the compression band 40 has a top rounded portion 42. In addition, the annular channel 33 has a complimentary rounded portion 44 (see, for example, FIG. 2A) for receiving the rounded portion 42. Advantageously, providing the rounded portions 42 and 44 reduces or minimizes stress between the collar portion 30 and the shank portion 28 once forces or a load are applied to the cutting tool 22 that might otherwise exist with, for example, flat or non-rounded engaging surfaces or the like.

In another aspect of the invention, the compression band 40 also has a beveled or chamfered portion 46 adjacent to or in contact with the top rounded portion 42. In another aspect of the invention, the compression band 40 also has a flat portion 48 adjacent to or in contact with beveled or chamfered portion 46 and the top rounded portion 42. The beveled or chamfered portion 46 and/or the flat portion 48 (or at least portions thereof) may be configured for engagement or cooperation with the front face 14 of the holder 12.

Thus, it will be appreciated that the compression band 40 acts as a bearing surface between the collar portion 30 and holder face 14, decreasing friction and promoting increased cutting tool 22 rotation for maintaining an evenly distributed self-sharpening effect during hard cutting tip 26 wear, thus enhancing cutting tool performance and increasing the longevity of the cutting tool.

In another aspect of the invention, the rearward surface 31 of the collar portion 30 is beveled or sloped toward an axially forward end 52 of the collar portion 30. In one example, the rearward surface 31 of the collar portion is beveled or sloped at an angle B (see FIG. 2A) in the range of about 3 degrees to about 5 degrees from a plane perpendicular to the longitudinal axis A-A of the cutting tool. It will be appreciated that least a portion of the rearward surface 31 of the collar portion 30 engages the front face 14 of the holder 12. Advantageously, the rearward surface 31 of the collar portion being beveled or sloped will reduce or minimize friction between the rearward surface 31 of the collar portion 30 and the front face 14 of the holder 12.

In another aspect, the retainer sleeve 32 may include one or more inwardly projecting protrusions 54 for cooperating with a retaining groove 56 formed on the shank portion 28 so as to maintain the positioning of the retainer sleeve 32 on the shank portion 28.

In another aspect, the collar portion 30 is configured to substantially cover the front face 14 of the holder 12 to protect the holder from wear during operation. In one aspect, the collar portion 30 has a diameter that is equal to the diameter of the front face 14.

Whereas particular aspects of this invention have been described above for purposes of illustration, it will be evident to those skilled in the art that numerous variations of the details of the present invention may be made without departing from the invention.

The invention claimed is:

1. A cutting tool assembly for mounting in a bore of a holder, the cutting tool assembly comprising:

a cutting tool having a head portion, a shank portion and a collar portion therebetween, the collar portion having an axially rearward surface that defines an annular channel adjacent an axially forward end of the shank portion;

a retainer sleeve substantially surrounding the shank portion, the retainer sleeve defining a slot that extends from an axial forward end to an axial rearward end of the retainer sleeve, wherein the retainer sleeve is resilient and compressible between an expanded state and a compressed state; and a compression band removably attached to the retainer sleeve, wherein the compression band in a first position is attached to the retainer sleeve and compresses the retainer sleeve to the compressed state and in a second position is not attached to the retainer sleeve, wherein the compression band has a top rounded portion and a chamfered portion adjacent the top rounded portion.

2. The cutting tool assembly of claim 1, wherein in the second position the compression band is received at least partially in the annular channel.

3. The cutting tool assembly of claim 2, wherein in the first position the compression band is circumferentially disposed about an outer surface of the retainer sleeve.

4. The cutting tool assembly of claim 3, wherein the compression band is configured to be slidable from the axial rearward end of the retainer sleeve to the annular channel.

5. The cutting tool assembly of claim 1, wherein the compression band is generally circular.

6. The cutting tool assembly of claim 1, wherein the compression band has an inner diameter that is less than an outside diameter of the retainer sleeve in the expanded state.

7. The cutting tool assembly of claim 1, wherein the compression band includes a friction reducing coating.

8. The cutting tool assembly of claim 1, wherein the compression band is formed of carbide, ceramic, coated ferrous or non-ferrous metals, thermoplastics or hard rubber elastomers.

9. The cutting tool assembly of claim 1, wherein the rearward surface of the collar portion is beveled toward an axially forward end of the collar portion.

10. The cutting tool assembly of claim 9, wherein the rearward surface of the collar portion is beveled at an angle in the range of about 3 degrees to about 5 degrees from a plane perpendicular to a longitudinal axis of the cutting tool.

11. A tool assembly, comprising:

a holder having a front face that defines a longitudinal bore extending at least partially through the holder;

a cutting tool having a head portion, a shank portion and a collar portion therebetween, the collar portion having an axially rearward surface that defines an annular channel adjacent an axially forward end of the shank portion;

a retainer sleeve substantially surrounding the shank portion and configured for being removably received in the longitudinal bore of the holder, the retainer sleeve defining a slot that extends from an axial forward end to an axial rearward end of the retainer sleeve, wherein the retainer sleeve is resilient and compressible between an expanded state and a compressed state; and a compression band removably attached to the retainer sleeve, wherein the compression band in a first position is attached to the retainer sleeve and compresses the retainer sleeve to the compressed state and in a second position is not attached to the retainer sleeve, wherein the compression band has a top rounded portion and a chamfered portion adjacent the top rounded portion.

12. The tool assembly of claim 11, wherein in the second position the compression band is received at least partially in the annular channel.

13. The tool assembly of claim 12, wherein in the first position the compression band is circumferentially disposed about an outer surface of the retainer sleeve.

14. The tool assembly of claim 11, wherein at least a portion of the compression band engages the front face of the holder.

15. The tool assembly of claim 11, wherein the retainer sleeve has an outer diameter in the expanded state that is greater than a diameter of the longitudinal bore.

16. The tool assembly of claim 11, wherein the rearward surface of the collar is beveled toward an axially forward end of the collar portion.

17. The tool assembly of claim 11, wherein the collar portion substantially covers the front face of the holder.

18. The tool assembly of claim 11, wherein at least a portion of the rearward surface of the collar portion engages the front face of the holder.

19. A cutting tool assembly for mounting in a bore of a holder, the cutting tool assembly comprising:

a cutting tool having a head portion, a shank portion and a collar portion therebetween, the collar portion having an axially rearward surface that defines an annular channel adjacent an axially forward end of the shank portion, wherein the rearward surface of the collar portion is beveled toward an axially forward end of the collar portion at an angle in the range of about 3 degrees to about 5 degrees from a plane perpendicular to a longitudinal axis of the cutting tool;

a retainer sleeve substantially surrounding the shank portion, the retainer sleeve defining a slot that extends from an axial forward end to an axial rearward end of the retainer sleeve, wherein the retainer sleeve is resilient and compressible between an expanded state and a compressed state; and a compression band removably attached to the retainer sleeve, wherein the compression band in a first position is attached to the retainer sleeve and compresses the retainer sleeve to the compressed state and in a second position is not attached to the retainer sleeve.

* * * * *